US011837825B2

(12) United States Patent
Liu et al.

(10) Patent No.: US 11,837,825 B2
(45) Date of Patent: Dec. 5, 2023

(54) CONNECTOR FOR BUS BAR PLUG ASSEMBLY

(71) Applicant: Tyco Electronics (Shanghai) Co. Ltd., Shanghai (CN)

(72) Inventors: Jiaoyong (Mac) Liu, Shanghai (CN); Jie (Roger) Luo, Shanghai (CN); Guangming (Suny) Zhao, Shanghai (CN); Kunlin Yao, Dongguan (CN)

(73) Assignee: Tyco Electronics (Shanghai) Co., Ltd., Shanghai (CN)

( * ) Notice: Subject to any disclaimer, the term of this patent is extended or adjusted under 35 U.S.C. 154(b) by 0 days.

(21) Appl. No.: 17/479,039

(22) Filed: Sep. 20, 2021

(65) Prior Publication Data

US 2022/0094122 A1 Mar. 24, 2022

(30) Foreign Application Priority Data

Sep. 18, 2020 (CN) ..... 202010985542.4

(51) Int. Cl.
*H01R 25/16* (2006.01)
*H01R 25/14* (2006.01)
*H01R 13/46* (2006.01)

(52) U.S. Cl.
CPC ..... *H01R 25/142* (2013.01); *H01R 13/46* (2013.01); *H01R 25/161* (2013.01)

(58) Field of Classification Search
CPC .... H01R 13/46; H01R 25/142; H01R 25/161; H01R 25/162
See application file for complete search history.

(56) References Cited

U.S. PATENT DOCUMENTS 9,142,902 B2 9/2015 Glick et al.
9,484,656 B2 11/2016 Doi et al.
(Continued)

FOREIGN PATENT DOCUMENTS

CN 104347994 A 2/2015
CN 108258483 A 7/2018
(Continued)

OTHER PUBLICATIONS

Chinese First Office Action dated May 31, 2023 with English translation thereof, corresponding to Application No. 202010985542.4, 20 pages.

*Primary Examiner* — Vanessa Girardi
(74) *Attorney, Agent, or Firm* — Barley Snyder

(57) ABSTRACT

A connector includes a first terminal assembly having a longitudinally extending first plate-shaped fixing portion, a longitudinally extending first terminal portion, and a substantially laterally extending first connection portion to connect the first plate-shaped fixing portion and the first terminal portion. A second terminal assembly is arranged opposite to and spaced apart from the first terminal assembly and includes a longitudinally extending second plate-shaped fixing portion, a longitudinally extending second terminal portion, and a substantially laterally extending second connection portion to connect the second plate-shaped fixing portion and the second terminal portion. A spacing between the first plate-shaped fixing portion and the second plate-shaped fixing portion is greater than a spacing between the first terminal portion and the second terminal portion.

17 Claims, 6 Drawing Sheets

(56) References Cited

U.S. PATENT DOCUMENTS

| | | | | |
|---|---|---|---|---|
| 10,193,258 | B2 | 1/2019 | Balser | |
| 10,826,215 | B2 * | 11/2020 | Zhang | H01R 13/04 |
| 11,177,599 | B2 * | 11/2021 | Horning | H01R 13/14 |
| 11,211,734 | B2 * | 12/2021 | Hung | H01R 13/6276 |

FOREIGN PATENT DOCUMENTS

| | | | | | |
|---|---|---|---|---|---|
| CN | 109510015 | A | | 3/2019 | |
| CN | 110391528 | A | | 10/2019 | |
| CN | 111564721 | A | | 8/2020 | |
| JP | 2015035352 | A | | 2/2015 | |
| TW | 109111668 | | * | 4/2020 | H01R 13/436 |

* cited by examiner

CONNECTOR FOR BUS BAR PLUG ASSEMBLY

CROSS-REFERENCE TO RELATED APPLICATIONS

This application claims the benefit of Chinese Patent Application No. CN 202010985542.4 filed on Sep. 18, 2020 in the China National Intellectual Property Administration, the whole disclosure of which is incorporated herein by reference.

FIELD OF THE INVENTION

The present invention relates to an electrical connector, and more particularly, to an electrical power connector for mating with a bus bar.

BACKGROUND

Power connectors according to the prior art typically include an insulation housing and positive and negative terminals disposed in the insulation housing. The power connectors may electrically connect a first wire and a second wire to a first bus bar and a second bus bar by the positive terminal and the negative terminal, respectively. Further, according to the prior art, the positive terminal and the negative terminal are generally arranged at both sides of the insulation housing in a width direction thereof, and the first wire and the second wire are usually electrically connected to outer sides of the positive terminal and the negative terminal of the power connector, respectively, which may increase a size of the power connector in the width direction. In addition, the positive terminal and the negative terminal are typically flat terminals, which may unnecessarily increase the width of the connector.

Accordingly, improved power connectors suitable for mating to one or more bus bars are desired.

SUMMARY

A connector according to an embodiment of the present disclosure comprises a first terminal assembly having a longitudinally extending first plate-shaped fixing portion, a longitudinally extending first terminal portion, and a substantially laterally extending first connection portion to connect the first plate-shaped fixing portion and the first terminal portion. A second terminal assembly is arranged opposite to, and spaced apart from, the first terminal assembly and includes a longitudinally extending second plate-shaped fixing portion, a longitudinally extending second terminal portion, and a substantially laterally extending second connection portion to connect the second plate-shaped fixing portion and the second terminal portion. A spacing between the first plate-shaped fixing portion and the second plate-shaped fixing portion is greater than a spacing between the first terminal portion and the second terminal portion.

BRIEF DESCRIPTION OF THE DRAWINGS

The invention will now be described by way of example with reference to the accompanying Figures, of which.

DETAILED DESCRIPTION OF THE EMBODIMENTS

Figure 1:
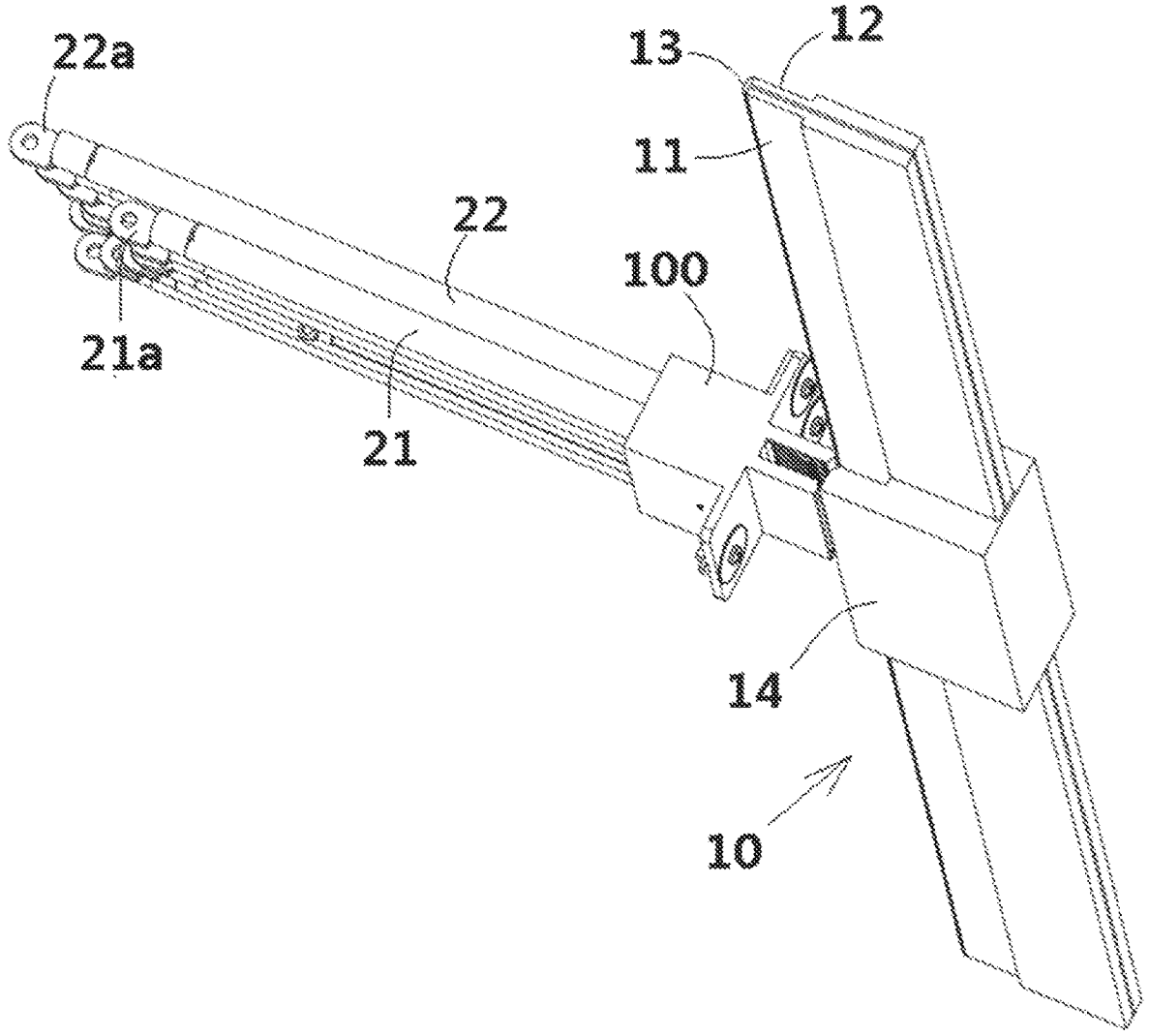
FIG. 1 is a schematic perspective view of a connector and a bus bar plug assembly connected with the connector according to an exemplary embodiment of the present disclosure.

Exemplary embodiments of the present disclosure will be described hereinafter in detail with reference to the attached drawings, wherein the like reference numerals refer to the like elements. The present disclosure may, however, be embodied in many different forms and should not be construed as being limited to the embodiment set forth herein; rather, these embodiments are provided so that the present disclosure will be thorough and complete, and will fully convey the concept of the disclosure to those skilled in the art.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

According to an embodiment of the present disclosure, a connector includes a first terminal assembly having a longitudinally extending first plate-shaped fixing portion, a longitudinally extending first terminal portion, and a substantially laterally extending first connection portion to connect the first plate-shaped fixing portion and the first terminal portion. A second terminal assembly of the connector is arranged opposite to the first terminal assembly at intervals and has a longitudinally extending second plate-shaped fixing portion, a longitudinally extending second terminal portion, and a substantially laterally extending second connection portion to connect the second plate-shaped fixing portion and the second terminal portion. A spacing between the first plate-shaped fixing portion and the second plate-shaped fixing portion is greater than a spacing between the first terminal portion and the second terminal portion.

Figure 2:
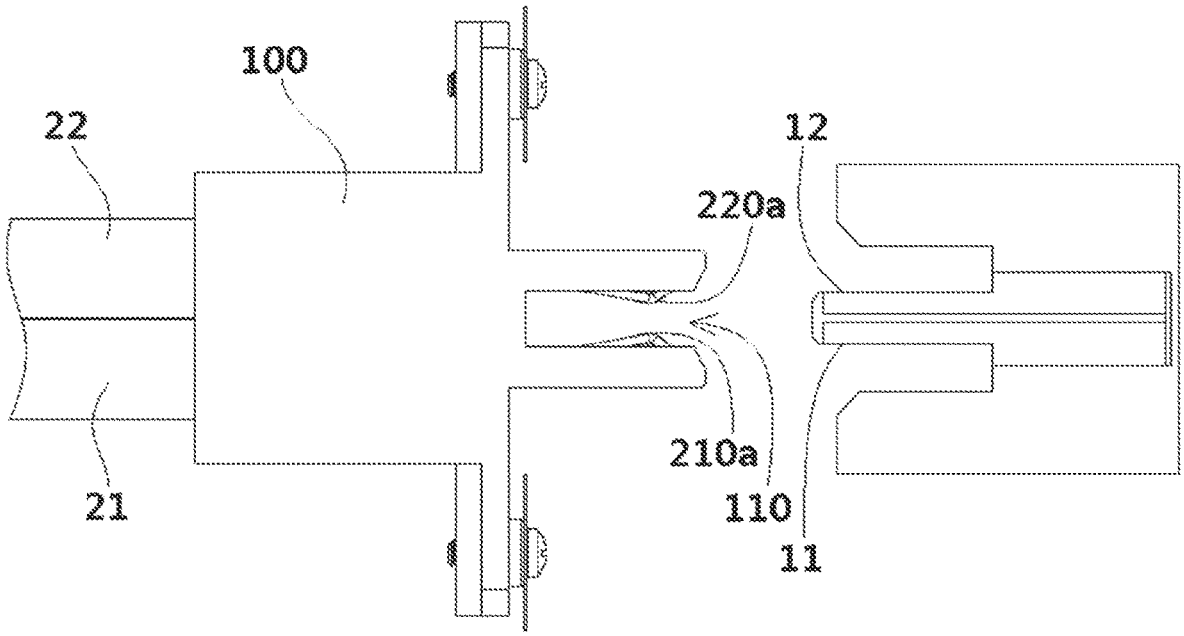
FIG. 2 is a plan view of the connector and the bus bar plug assembly shown in FIG. 1.
Figure 3:
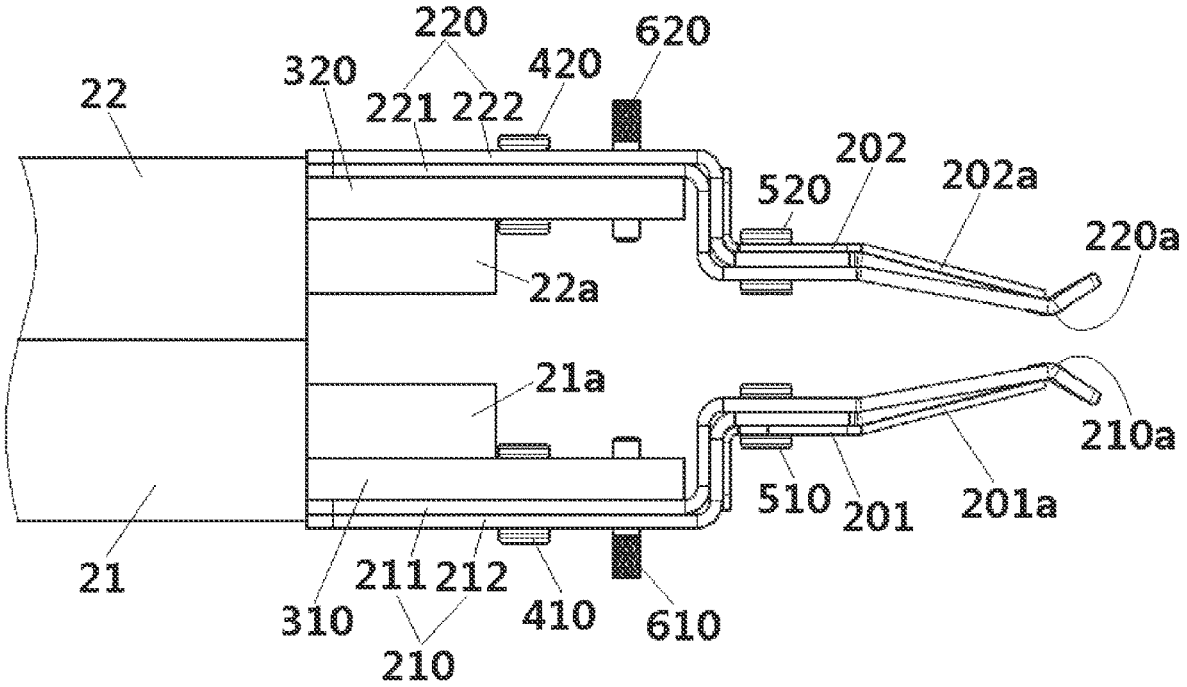
FIG. 3 is a plan view of a first terminal assembly, a second terminal assembly, a first wire and a second wire of the connector shown in FIG. 2.

FIG. 1 is a schematic perspective view of a connector and a bus bar plug assembly 10 connected with the connector according to an exemplary embodiment of the present disclosure. FIG. 2 is a plan view of the connector and the bus bar plug assembly 10 shown in FIG. 1. FIG. 3 is a plan view of a first terminal assembly, a second terminal assembly, a first wire and a second wire of the connector shown in FIG. 2.

As shown in FIGS. 1-3, in the illustrated embodiment, the connector includes a first terminal assembly 210 and a second terminal assembly 220. As set forth in greater detail herein, the first terminal assembly 210 has a longitudinally extending first plate-shaped fixing portion, a longitudinally extending first terminal portion, and a substantially laterally extending first connection portion to connect the first plate-shaped fixing portion and the first terminal portion. The second terminal assembly 220 is arranged opposite to the first terminal assembly 210 at intervals. The second terminal assembly 220 also includes a longitudinally extending second plate-shaped fixing portion, a longitudinally extending second terminal portion, and a substantially laterally extending second connection portion to connect the second plate-shaped fixing portion and the second terminal portion. In the exemplary embodiment, a spacing between the first plate-shaped fixing portion of the first terminal assembly 210 and the second plate-shaped fixing portion of the second terminal assembly 220 is greater than a spacing between the first terminal portion of the first terminal assembly 210 and the second terminal portion of the second terminal assembly 220.

The connector further includes a first wire 21 and a second wire 22. The first wire 21 is electrically connected to the first terminal assembly 210 at one end thereof. The second wire 22 is electrically connected to the second terminal assembly 220 at one end thereof. The first wire 21 and the second wire 22 are electrically connected to opposite inner sides of the first terminal assembly 210 and the second terminal assembly 220, respectively.

Still referring to FIGS. 1-3, the connector further includes a first conductive block 310 electrically connected on an inner surface of the first plate-shaped fixing portion of the first terminal assembly 210. The first wire 21 has a first electrical connection piece 21*a* crimped on one end thereof. The first electrical connection piece 21*a* is configured to be electrically connected to an inner surface of the first conductive block 310. The first electrical connection piece 21*a* may be connected to the inner surface of the first conductive block 310 by welding, riveting or bolting, for example.

The connector further includes a second conductive block 320 electrically connected to an inner surface of the second plate-shaped fixing portion of the second terminal assembly 220. The second wire 22 has a second electrical connection piece 22*a* crimped on one end thereof. The second electrical connection piece 22*a* is configured to be electrically connected to an inner surface of the second conductive block 320. The second electrical connection piece 22*a* may be connected to the inner surface of the second conductive block 320 by welding, riveting or bolting, for example.

Figure 4:
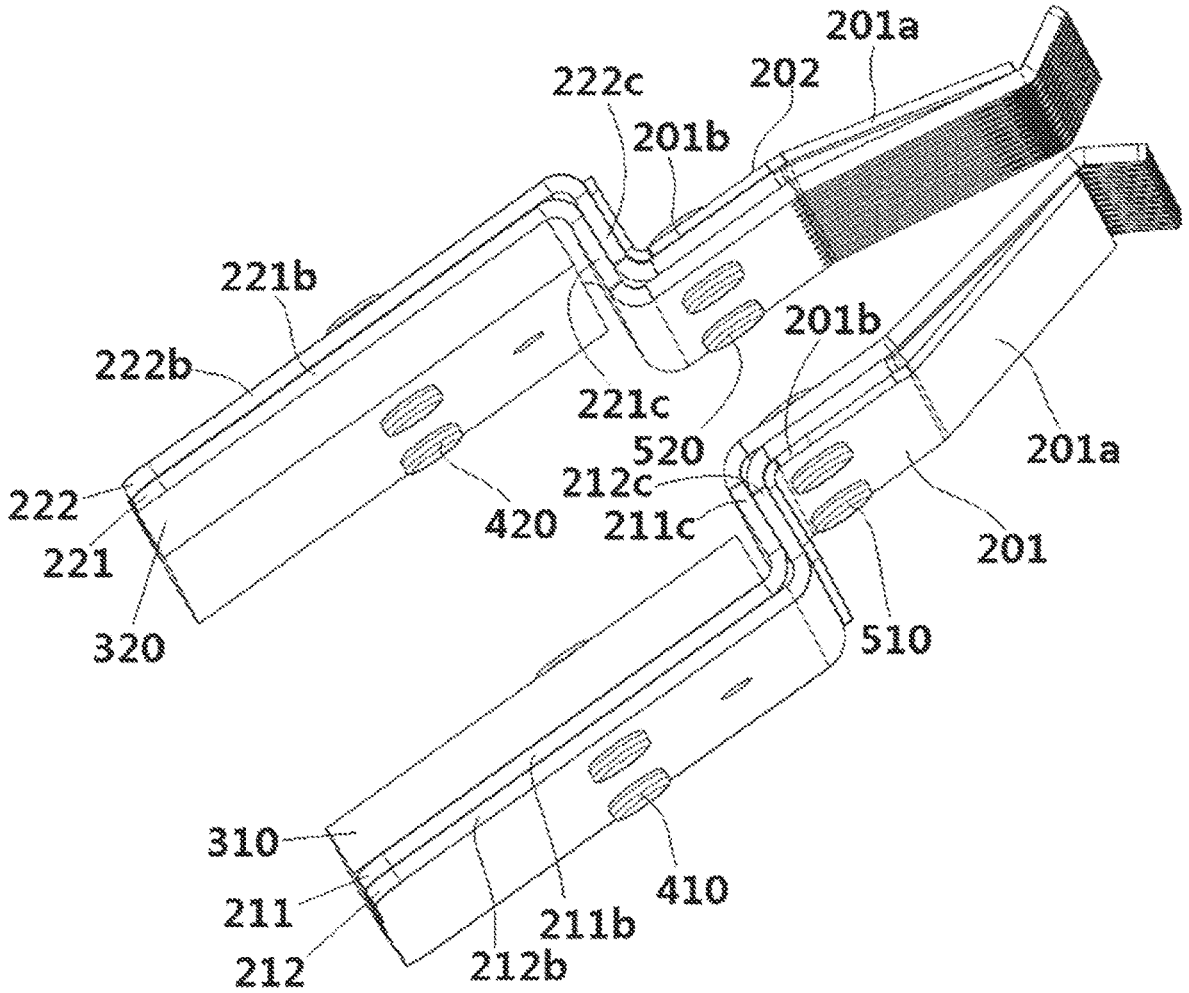
FIG. 4 is a schematic perspective view of the first terminal assembly and the second terminal assembly shown in FIG. 3.
Figure 5:
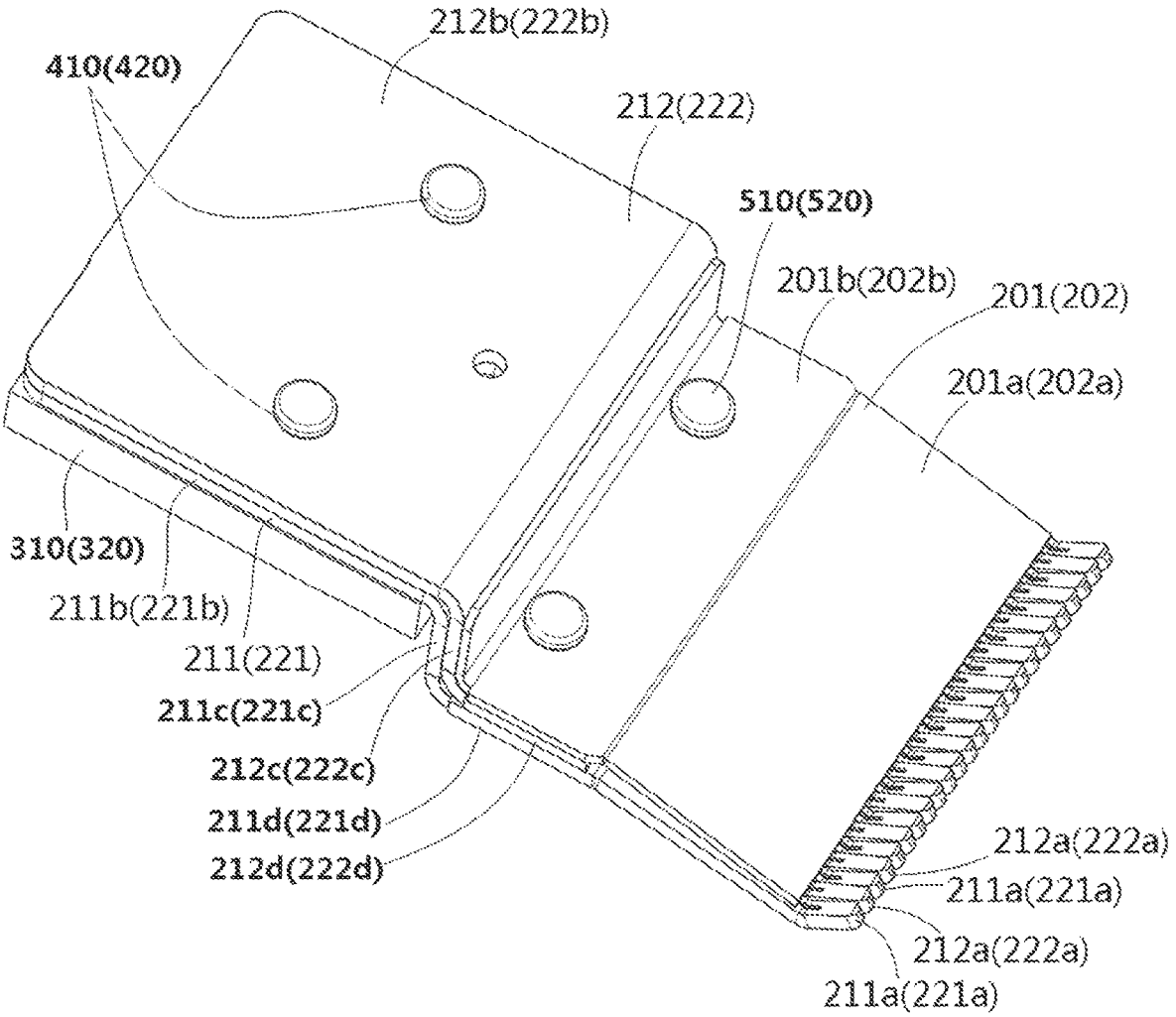
FIG. 5 is a schematic enlarged view of the first terminal assembly and the second terminal assembly shown in FIG. 4.
Figure 6:
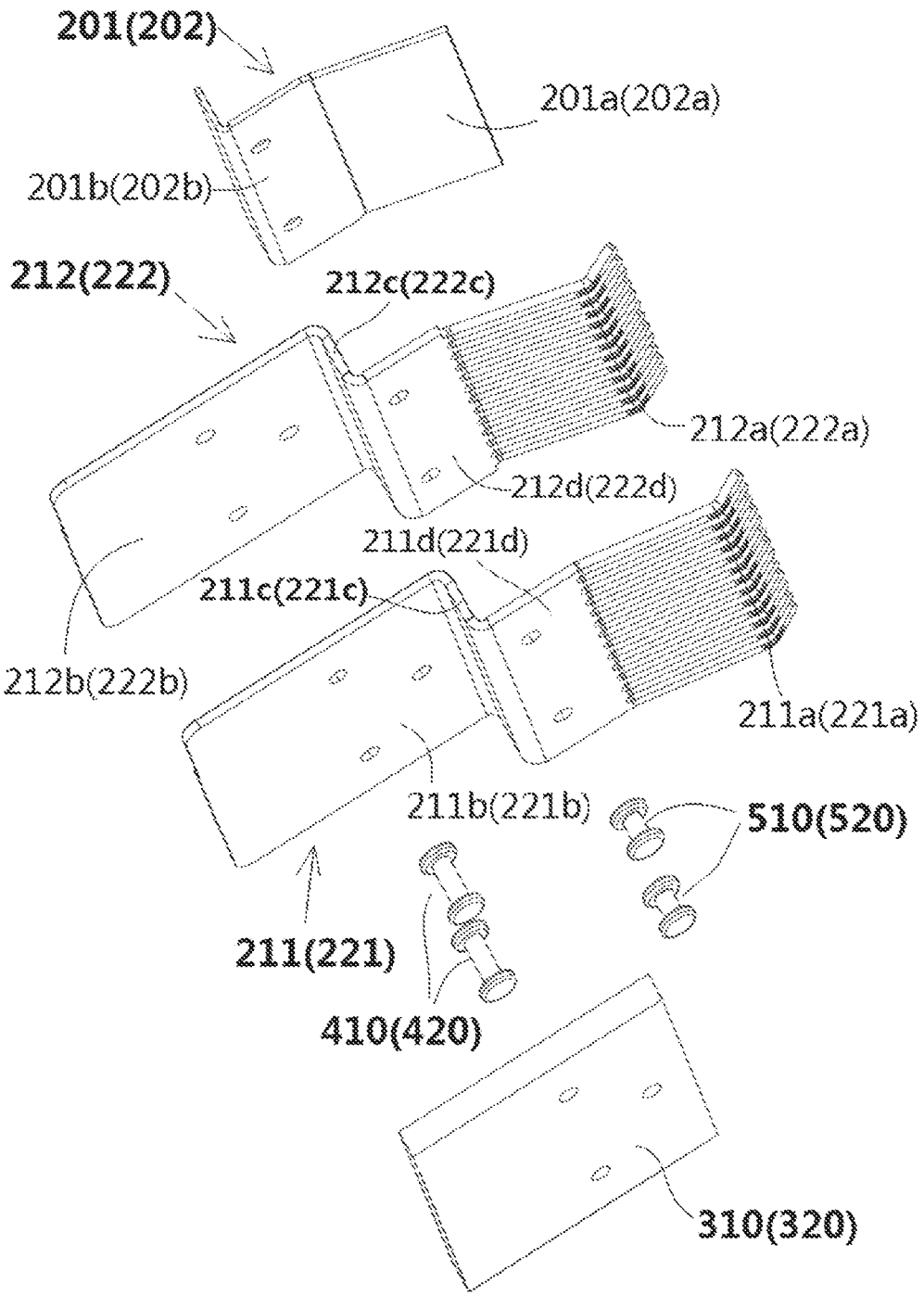
FIG. 6 is a schematic exploded view of the first terminal assembly and the second terminal assembly shown in FIG. 5.

FIG. 4 is a schematic perspective view of the first terminal assembly and the second terminal assembly shown in FIG. 3. FIG. 5 is a schematic enlarged view of the first terminal assembly and the second terminal assembly shown in FIG. 4. FIG. 6 is a schematic exploded view of the first terminal assembly and the second terminal assembly shown in FIG. 5.

Referring now to FIGS. 1-6, in the illustrated embodiment, the first terminal assembly 210 includes a first terminal 211 and a second terminal 212 abuts or is laminated on an outer side of the first terminal 211. The first terminal 211 has a first substrate portion 211*b* at one end thereof, a first cantilever portion 211*d* at the other end thereof, and a first connection plate portion 211*c* to connect the first substrate portion 211*b* and the first cantilever portion 211*d*. The second terminal 212 has a second substrate portion 212*b* at one end thereof, a second cantilever portion 212*d* at the other end thereof, and a second connection plate portion 212*c* to connect the second substrate portion 212*b* and the second cantilever portion 212*d*. In one embodiment, the first substrate portion 211*b* abuts or is laminated on an inner surface of the second substrate portion 212*b*, and the first conductive block 310 abuts or is laminated on an inner surface of the first substrate portion 211*b*.

The first plate-shaped fixing portion of the first terminal assembly 210 is formed and defined by the first substrate portion 211*b* and the second substrate portion 212*b* together. The first terminal portion of the first terminal assembly 210 is formed and defined by the first cantilever portion 211*d* and the second cantilever portion 212*d* together. The first connection portion of the first terminal assembly 210 is formed and defined by the first connection plate portion 211*c* and the second connection plate portion 212*c* together. The first cantilever portion 211*d* has a plurality of first elastic arms 211*a*, and the second cantilever portion 212*d* has a plurality of second elastic arms 212*a*. The plurality of first cantilever portion 212*a* and the plurality of second elastic arms 212*a* are alternatively arranged in a row to be in electrical contact with one first bus bar 11.

The second terminal assembly 220 includes a third terminal 221 and a fourth terminal 222 abuts or is laminated on an outer side of the third terminal 221. The third terminal 221 has a third substrate portion 221*b* at one end thereof, a third cantilever portion 221*d* at the other end thereof, and a third connection plate portion 221*c* to connect the third substrate portion 221*b* and the third cantilever portion 221*d*. The fourth terminal 222 has a fourth substrate portion 222*b* at one end thereof, a fourth cantilever portion 222*d* at the other end thereof, and a fourth connection plate portion 222*c* to connect the fourth substrate portion 222*b* and the fourth cantilever portion 222*d*. In one exemplary embodiment, the third substrate portion 221*b* abuts or is laminated on an inner surface of the fourth substrate portion 222*b*, and the second conductive block 320 abuts or is laminated on an inner surface of the third substrate portion 221*b*.

The second plate-shaped fixing portion of the second terminal assembly 220 is formed and defined by the third substrate portion 221*b* and the fourth substrate portion 222*b* together. The second terminal portion of the second terminal assembly 220 is formed and defined by the third cantilever portion 221*d* and the fourth cantilever portion 222*d* together. The second connection portion of the second terminal assembly 220 is formed and defined by the third connection plate portion 221*c* and the fourth connection plate portion 222*c* together. The third cantilever portion 221*d* has a plurality of third elastic arms 221*a*, and the fourth cantilever portion 222*d* has a plurality of fourth elastic arms 222*a*. The plurality of third elastic arms 221*a* and the plurality of fourth elastic arms 222*a* are alternatively arranged in a row to be in electrical contact with one second bus bar 12.

Still referring to FIGS. 1-6, in the illustrated embodiment, the connector further includes a first auxiliary terminal 201. The first auxiliary terminal 201 includes a first fixing portion 201*b* and a first auxiliary elastic arm 201*a*. The first fixing portion 201*b* abuts or is laminated on outer sides of the second connection plate portion 212*c* and the second cantilever portion 212*d* of the second terminal 212. The first auxiliary elastic arm 201*a* is abutted against both the first elastic arm 211*a* and the second elastic arm 212*a*. The connector further includes a second auxiliary terminal 202. The second auxiliary terminal 202 includes a second fixing portion 202*b* and a second auxiliary elastic arm 202*a*. The second fixing portion 202*b* abuts or is laminated on outer sides of the fourth connection plate portion 222*c* and the fourth cantilever portion 222*d* of the fourth terminal 222. The second auxiliary elastic arm 202*a* is abutted against both the third elastic arm 221*a* and the fourth elastic arm 222*a*.

The first conductive block 310, the first terminal 211 and the second terminal 212 are riveted together by a first rivet 410. The second conductive block 320, the third terminal 221 and the fourth terminal 222 are riveted together by a second rivet 420. The first auxiliary terminal 201, the first terminal 211 and the second terminal 212 are riveted together by a third rivet 510. The second auxiliary terminal 202, the third terminal 221 and the fourth terminal 222 are riveted together by a fourth rivet 520.

The connector further includes an insulation housing 100 into which the first terminal assembly 210 and the second terminal assembly 220 are mounted. The first conductive block 310, the first terminal 211 and the second terminal 212 are connected to the insulation housing 100 by a first pin 610. The second conductive block 320, the third terminal 221 and the fourth terminal 222 are connected to the insulation housing 100 by a second pin 620.

The first terminal assembly 210 is identical to the second terminal assembly 220, and the first terminal assembly 210 and the second terminal assembly 220 are symmetrically arranged in the insulation housing 100. Each of the first terminal 211, the second terminal 212, the third terminal 221 and the fourth terminal 222 are bent into a zigzag or Z shape (i.e., a shape having alternating opposite turns along its length), so that the first terminal assembly 210 and the second terminal assembly 220 are in a zigzag or Z shape.

The first wire 21 and the second wire 22 extend into the insulation housing 100 from one side of the insulation housing 100, and the first bus bar 11 and the second bus bar 12 are inserted into the insulation housing 100 from the other side of the insulation housing 100.

A first elastic contact arm 210*a* of the first terminal assembly 210 is formed by the plurality of first elastic arms 211*a* and the plurality of second elastic arms 212*a* together. A second elastic contact arm 220*a* of the second terminal assembly 220 is formed by the plurality of third elastic arms 221*a* and the plurality of fourth elastic arms 222*a* together.

In the exemplary illustrated embodiment, a slot 110 is formed in the other side of the insulation housing 100, and the first elastic contact arm 210*a* and the second elastic contact arm 220*a* are located in the slot 110 and adapted to be brought into electrical contact with the first bus bar 11 and the second bus bar 12 of the bus bar plug assembly 10 inserted into the slot 110, respectively.

The bus bar plug assembly 10 further includes an insulation separation layer 13 disposed between the first bus bar 11 and the second bus bar 12, and the first bus bar 11 and the second bus bar 12 are integrated on both sides of the insulation separation layer 13. The bus bar plug assembly 10 further includes an insulation body 14, in which the first bus bar 11, the second bus bar 12 and the insulation separation layer 13 integrated together are assembled.

In one embodiment, the connector includes a plurality of first wires 21 arranged in a row and electrically connected to the first terminal assembly 210 so as to be electrically connected to the first bus bar 11 via the first terminal assembly 210. The connector includes a plurality of second wires 22 arranged in a row and electrically connected to the second terminal assembly 220 so as to be electrically connected to the second bus bar 12 via the second terminal assembly 220.

According to embodiments of the present disclosure, the connector may be a power connector. In this case, one of the first wire 21 and the second wire 22 is a positive wire, and the other is a negative wire. Further, one of the first bus bar 11 and the second bus bar 12 is a positive bus bar, and the other is a negative bus bar.

It should be appreciated for those skilled in this art that the above embodiments are intended to be illustrated, and not restrictive. For example, many modifications may be made to the above embodiments by those skilled in this art, and various features described in different embodiments may be freely combined with each other without conflicting in configuration or principle.

Although several exemplary embodiments have been shown and described, it would be appreciated by those skilled in the art that various changes or modifications may be made in these embodiments without departing from the principles and spirit of the disclosure, the scope of which is defined in the claims and their equivalents.

As used herein, an element recited in the singular and proceeded with the word "a" or "an" should be understood as not excluding plural of said elements or steps, unless such exclusion is explicitly stated. Furthermore, references to "one embodiment" of the present disclosure are not intended to be interpreted as excluding the existence of additional embodiments that also incorporate the recited features. Moreover, unless explicitly stated to the contrary, embodiments "comprising" or "having" an element or a plurality of elements having a particular property may include additional such elements not having that property.

What is claimed is:

1. A connector, comprising:

a first terminal assembly having a longitudinally extending first plate-shaped fixing portion, a longitudinally extending first terminal portion, and a substantially laterally extending first connection portion to connect the first plate-shaped fixing portion and the first terminal portion;

a second terminal assembly arranged opposite to and spaced apart from the first terminal assembly and having a longitudinally extending second plate-shaped fixing portion, a longitudinally extending second terminal portion, and a substantially laterally extending second connection portion to connect the second plate-shaped fixing portion and the second terminal portion, a spacing between the first plate-shaped fixing portion and the second plate-shaped fixing portion is greater than a spacing between the first terminal portion and the second terminal portion;

a first wire electrically connected to the first terminal assembly at one end thereof;

a second wire electrically connected to the second terminal assembly at one end thereof, wherein the first wire and the second wire are electrically connected to opposite inner sides of the first terminal assembly and the second terminal assembly, respectively; and a first conductive block electrically connected on an inner surface of the first plate-shaped fixing portion of the first terminal assembly, the first wire having a first electrical connection piece crimped on one end thereof, the first electrical connection piece configured to be electrically connected to an inner surface of the first conductive block.

2. The connector according to claim 1, further comprising a second conductive block electrically connected to an inner surface of the second plate-shaped fixing portion of the second terminal assembly, the second wire having a second electrical connection piece crimped on one end thereof, the second electrical connection piece configured to be electrically connected to an inner surface of the second conductive block.

3. The connector according to claim 2, wherein the first terminal assembly comprises:

a first terminal having a first substrate portion at a first end thereof, a first cantilever portion at a second end thereof, and a first connection plate portion to connect the first substrate portion and the first cantilever portion; and a second terminal arranged on an outer side of the first terminal and having a first substrate portion at a first end thereof, a first cantilever portion at a second end thereof, and a first connection plate portion connecting the first substrate portion and the first cantilever portion.

4. The connector according to claim 3, wherein the first substrate portion is arranged on an inner surface of the second substrate portion, and the first conductive block is arranged on an inner surface of the first substrate portion.

5. The connector according to claim 3, wherein:

the first plate-shaped fixing portion of the first terminal assembly includes the first substrate portion and the second substrate portion;

the first terminal portion of the first terminal assembly includes the first cantilever portion and the second cantilever portion; and the first connection portion of the first terminal assembly is formed by the first connection plate portion and the second connection plate portion.

6. The connector according to claim 3, wherein the first cantilever portion includes a plurality of first elastic arms and the second cantilever portion includes a plurality of second elastic arms, the plurality of first elastic arms and the plurality of second elastic arms are alternatively arranged in a row for electrically contacting a first bus bar.

7. The connector according to claim 3, wherein the second terminal assembly comprises:

a third terminal having a third substrate portion at a first end thereof, a third cantilever portion at a second end thereof, and a third connection plate portion connecting the third substrate portion and the third cantilever portion; and a fourth terminal arranged on an outer side of the third terminal and having a fourth substrate portion at a first end thereof, a fourth cantilever portion at a second end thereof, and a fourth connection plate portion connecting the fourth substrate portion and the fourth cantilever portion, for each of the first terminal assembly and the second terminal assembly, respective laterally extending connection portions are arranged generally perpendicularly to respective longitudinally extending plate-shaped fixing portions and the longitudinally extending terminal portions.

8. The connector according to claim 7, wherein:

the second plate-shaped fixing portion of the second terminal assembly is formed by the third substrate portion and the fourth substrate portion together;

the second terminal portion of the second terminal assembly is formed by the third cantilever portion and the fourth cantilever portion together; and the second connection portion of the second terminal assembly is formed by the third connection plate portion and the fourth connection plate portion together.

9. The connector according to claim 7, wherein:

the third cantilever portion has a plurality of third elastic arms, and the fourth cantilever portion has a plurality of fourth elastic arms; and the plurality of third elastic arms and the plurality of fourth elastic arms are alternatively arranged in a row to be in electrical contact with a second bus bar.

10. The connector according to claim 9, further comprising a first auxiliary terminal comprising:

a first fixing portion arranged on outer sides of the second connection plate portion and the second cantilever portion of the second terminal; and a first auxiliary elastic arm abutted against both the first elastic arm and the second elastic arm.

11. The connector according to claim 10, further comprising a second auxiliary terminal comprising:

a second fixing portion arranged on outer sides of the fourth connection plate portion and the fourth cantilever portion of the fourth terminal; and a second auxiliary elastic arm abutted against both the third elastic arm and the fourth elastic arm.

12. The connector according to claim 7, wherein the third substrate portion is arranged on an inner surface of the fourth substrate portion, and the second conductive block is arranged on an inner surface of the third substrate portion.

13. The connector according to claim 12, wherein:

the first conductive block, the first terminal and the second terminal are riveted together;

the second conductive block, the third terminal and the fourth terminal are riveted together;

the first auxiliary terminal, the first terminal and the second terminal are riveted together; and the second auxiliary terminal, the third terminal and the fourth terminal are riveted together.

14. The connector according to claim 12, further comprising an insulation housing into which the first terminal assembly and the second terminal assembly are mounted, the first conductive block, the first terminal and the second terminal are connected to the insulation housing by a first fastener, and the second conductive block, the third terminal and the fourth terminal are connected to the insulation housing by a second fastener.

15. The connector according to claim 14, wherein the first terminal assembly is identical to the second terminal assembly, and the first terminal assembly and the second terminal assembly are symmetrically arranged in the insulation housing.

16. The connector according to claim 14, further comprising:

a plurality of first wires and a plurality of second wires extending into the insulation housing from a first side of the insulation housing, a first bus bar and a second bus bar inserted into the insulation housing from a second side of the insulation housing;

an insulation separation layer disposed between the first bus bar and the second bus bar, the first bus bar and the second bus bar integrated on both sides of the insulation separation layer; and an insulation body in which the first bus bar, the second bus bar and the insulation separation layer integrated together are assembled.

17. The connector according to claim 16, wherein a first elastic contact arm of the first terminal assembly is formed by the plurality of first elastic arms and the plurality of second elastic arms together, and a second elastic contact arm of the second terminal assembly is formed by the plurality of third elastic arms and the plurality of fourth elastic arms together, a slot is formed in the second side of the insulation housing, and the first elastic contact arm and the second elastic contact arm are located in the slot and electrically contacting the first bus bar and the second bus bar, respectively.

* * * * *